US009779747B2

(12) United States Patent
Wang et al.

(10) Patent No.: US 9,779,747 B2
(45) Date of Patent: Oct. 3, 2017

(54) CODING/DECODING METHOD, APPARATUS, AND SYSTEM FOR AUDIO SIGNAL

(71) Applicant: HUAWEI TECHNOLOGIES CO., LTD., Shenzhen, Guangdong (CN)

(72) Inventors: Bin Wang, Beijing (CN); Zexin Liu, Beijing (CN); Lei Miao, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/391,339

(22) Filed: Dec. 27, 2016

(65) Prior Publication Data

US 2017/0110137 A1 Apr. 20, 2017

Related U.S. Application Data

(63) Continuation of application No. PCT/CN2015/074704, filed on Mar. 20, 2015.

(30) Foreign Application Priority Data

Jun. 26, 2014 (CN) ..... 2014 1 0294752

(51) Int. Cl.
*G10L 19/00* (2013.01)
*G10L 19/12* (2013.01)
(Continued)

(52) U.S. Cl.
CPC ..... *G10L 19/12* (2013.01); *G10L 19/0204* (2013.01); *G10L 19/26* (2013.01)

(58) Field of Classification Search
CPC ..... G10L 19/18; G10L 19/0204; G10L 19/06
(Continued)

(56) References Cited

U.S. PATENT DOCUMENTS 8,244,547 B2 * 8/2012 Sudo ..... G10L 21/038 704/203
2007/0147518 A1 6/2007 Bessette
(Continued)

FOREIGN PATENT DOCUMENTS

CN 101261834 A 9/2008
CN 101521014 A 9/2009
(Continued)

OTHER PUBLICATIONS

Fuchs G et al:"a new post-filtering for artificially replicated high-band in speech coders", May 14, 2006,XP10930279, total 4 pages.
(Continued)

*Primary Examiner* — Jakieda Jackson
(74) *Attorney, Agent, or Firm* — Huawei Technologies Co., Ltd.

(57) ABSTRACT

Embodiments of the present invention provide a coding/decoding method, apparatus, and system. According to the coding method, de-emphasis processing is performed on a full band signal by using a de-emphasis parameter determined according to a characteristic factor of an input audio signal, and then the full band signal is coded and sent to a decoder, so that the decoder performs corresponding de-emphasis decoding processing on the full band signal according to the characteristic factor of the input audio signal and restores the input audio signal. This resolves a prior-art problem that an audio signal restored by a decoder is apt to have signal distortion, and implements adaptive de-emphasis processing on the full band signal according to the characteristic factor of the audio signal to enhance coding performance, so that the input audio signal restored by the decoder has relatively high fidelity and is closer to an original signal.

20 Claims, 4 Drawing Sheets

(51) Int. Cl.
*G10L 19/02* (2013.01)
*G10L 19/26* (2013.01)

(58) Field of Classification Search
USPC ..... 704/500
See application file for complete search history.

(56) References Cited

U.S. PATENT DOCUMENTS

| | | | |
|---|---|---|---|
| 2007/0299655 | A1 | 12/2007 | Laaksonen et al. |
| 2008/0219344 | A1 | 9/2008 | Suzuki et al. |
| 2009/0198498 | A1 | 8/2009 | Ramabadran et al. |
| 2011/0282655 | A1 | 11/2011 | Endo |
| 2013/0117029 | A1 | 5/2013 | Liu et al. |

FOREIGN PATENT DOCUMENTS

| | | | |
|---|---|---|---|
| NO | 2010070770 | A1 | 6/2010 |
| NO | 2013066238 | A2 | 5/2013 |

OTHER PUBLICATIONS

Jax P et al:"Bandwidth extension of speech signals: a catalyst for the introduction of wideband speech coding?", May 1, 2006,XP1546248, total 6 pages.

* cited by examiner

CODING/DECODING METHOD, APPARATUS, AND SYSTEM FOR AUDIO SIGNAL

CROSS-REFERENCE TO RELATED APPLICATIONS

This application is a continuation of International Application No. PCT/CN2015/074704, filed on Mar. 20, 2015. This application claims priority to Chinese Patent Application No. 201410294752.3, filed on Jun. 26, 2014, the disclosure of which is hereby incorporated by reference in its entirety.

TECHNICAL FIELD

The present invention relates to audio signal processing technologies, and in particular, to a time domain based coding/decoding method, apparatus, and system.

BACKGROUND

To save channel capacity and storage space, considering that human ears are less sensitive to high frequency information than to low frequency information of an audio signal, the high frequency information is usually cut, resulting in decreased audio quality. Therefore, a bandwidth extension technology is introduced to reconstruct the cut high frequency information, so as to improve the audio quality. As the rate increases, with coding performance ensured, a wider band of a high frequency part that can be coded enables a receiver to obtain a wider-band and higher-quality audio signal.

In the prior art, in a condition of a high rate, a frequency spectrum of an input audio signal may be coded in a full band by using the bandwidth extension technology. A basic principle of the coding is: performing band-pass filtering processing on the input audio signal by using a band pass filter (BPF) to obtain a full band signal of the input audio signal; performing energy calculation on the full band signal to obtain an energy Ener0 of the full band signal; coding a high frequency band signal by using a super wide band (SWB) time band extension (TBE) encoder to obtain high frequency band coding information; determining, according to the high frequency band signal, a full band linear predictive coding (LPC) coefficient and a full band (FB) excitation signal that are used to predict the full band signal; performing prediction processing according to the LPC coefficient and the FB excitation signal to obtain a predicted full band signal; performing de-emphasis processing on the predicted full band signal to determine an energy Ener1 of the predicted full band signal that has undergone de-emphasis processing; and calculating an energy ratio of Ener1 to Ener0. The high frequency band coding information and the energy ratio are transmitted to a decoder, so that the decoder can restore the full band signal of the input audio signal according to the high frequency band coding information and the energy ratio, and restore the input audio signal.

In the foregoing solution, the input audio signal restored by the decoder is apt to have relatively severe signal distortion.

SUMMARY

Embodiments of the present invention provide a coding/decoding method, apparatus, and system, so as to relieve or resolve a prior-art problem that an input audio signal restored by a decoder is apt to have relatively severe signal distortion.

According to a first aspect, the present invention provides a coding method, including:

coding, by a coding apparatus, a low frequency band signal of an input audio signal to obtain a characteristic factor of the input audio signal;

performing, by the coding apparatus, coding and spread spectrum prediction on a high frequency band signal of the input audio signal to obtain a first full band signal;

performing, by the coding apparatus, de-emphasis processing on the first full band signal, where a de-emphasis parameter of the de-emphasis processing is determined according to the characteristic factor;

calculating, by the coding apparatus, a first energy of the first full band signal that has undergone de-emphasis processing;

performing, by the coding apparatus, band-pass filtering processing on the input audio signal to obtain a second full band signal;

calculating, by the coding apparatus, a second energy of the second full band signal;

calculating, by the coding apparatus, an energy ratio of the second energy of the second full band signal to the first energy of the first full band signal; and sending, by the coding apparatus to a decoding apparatus, a bitstream resulting from coding the input audio signal, where the bitstream includes the characteristic factor, high frequency band coding information, and the energy ratio of the input audio signal.

With reference to the first aspect, in a first possible implementation manner of the first aspect, the method further includes:

obtaining, by the coding apparatus, a quantity of characteristic factors;

determining, by the coding apparatus, an average value of the characteristic factors according to the characteristic factors and the quantity of the characteristic factors; and determining, by the coding apparatus, the de-emphasis parameter according to the average value of the characteristic factors.

With reference to the first aspect or the first possible implementation manner of the first aspect, in a second possible implementation manner of the first aspect, the performing, by the coding apparatus, spread spectrum prediction on a high frequency band signal of the input audio signal to obtain a first full band signal includes:

determining, by the coding apparatus according to the high frequency band signal, an LPC coefficient and a full band excitation signal that are used to predict a full band signal; and performing, by the coding apparatus, coding processing on the LPC coefficient and the full band excitation signal to obtain the first full band signal.

With reference to any one of the first aspect or the first or the second possible implementation manner of the first aspect, in a third possible implementation manner of the first aspect, the performing, by the coding apparatus, de-emphasis processing on the first full band signal includes:

performing, by the coding apparatus, frequency spectrum movement correction on the first full band signal, and performing frequency spectrum reflection processing on the corrected first full band signal; and performing, by the coding apparatus, the de-emphasis processing on the first full band signal that has undergone frequency spectrum reflection processing.

With reference to any one of the first aspect or the first to the third possible implementation manners of the first aspect, in a fourth possible implementation manner of the first aspect, the characteristic factor is used to reflect a characteristic of the audio signal, and includes a voicing factor, a spectral tilt, a short-term average energy, or a short-term zero-crossing rate.

According to a second aspect, the present invention provides a decoding method, including:

receiving, by a decoding apparatus, an audio signal bitstream sent by a coding apparatus, where the audio signal bitstream includes a characteristic factor, high frequency band coding information, and an energy ratio of an audio signal corresponding to the audio signal bitstream;

performing, by the decoding apparatus, low frequency band decoding on the audio signal bitstream by using the characteristic factor to obtain a low frequency band signal;

performing, by the decoding apparatus, high frequency band decoding on the audio signal bitstream by using the high frequency band coding information to obtain a high frequency band signal;

performing, by the decoding apparatus, spread spectrum prediction on the high frequency band signal to obtain a first full band signal;

performing, by the decoding apparatus, de-emphasis processing on the first full band signal, where a de-emphasis parameter of the de-emphasis processing is determined according to the characteristic factor;

calculating, by the decoding apparatus, a first energy of the first full band signal that has undergone de-emphasis processing;

obtaining, by the decoding apparatus, a second full band signal according to the energy ratio included in the audio signal bitstream, the first full band signal that has undergone de-emphasis processing, and the first energy, where the energy ratio is an energy ratio of an energy of the second full band signal to the first energy; and restoring, by the decoding apparatus, the audio signal corresponding to the audio signal bitstream according to the second full band signal, the low frequency band signal, and the high frequency band signal.

With reference to the second aspect, in a first possible implementation manner of the second aspect, the method further includes:

obtaining, by the decoding apparatus, a quantity of characteristic factors through decoding;

determining, by the decoding apparatus, an average value of the characteristic factors according to the characteristic factors and the quantity of the characteristic factors; and determining, by the decoding apparatus, the de-emphasis parameter according to the average value of the characteristic factors.

With reference to the second aspect or the first possible implementation manner of the second aspect, in a second possible implementation manner of the second aspect, the performing, by the decoding apparatus, spread spectrum prediction on the high frequency band signal to obtain a first full band signal includes:

determining, by the decoding apparatus according to the high frequency band signal, an LPC coefficient and a full band excitation signal that are used to predict a full band signal; and performing, by the decoding apparatus, coding processing on the LPC coefficient and the full band excitation signal to obtain the first full band signal.

With reference to any one of the second aspect or the first or the second possible implementation manner of the second aspect, in a third possible implementation manner of the second aspect, the performing, by the decoding apparatus, de-emphasis processing on the first full band signal includes:

performing, by the decoding apparatus, frequency spectrum movement correction on the first full band signal, and performing frequency spectrum reflection processing on the corrected first full band signal; and performing, by the decoding apparatus, the de-emphasis processing on the first full band signal that has undergone frequency spectrum reflection processing.

With reference to any one of the second aspect or the first to the third possible implementation manners of the second aspect, in a fourth possible implementation manner of the second aspect, the characteristic factor is used to reflect a characteristic of the audio signal, and includes a voicing factor, a spectral tilt, a short-term average energy, or a short-term zero-crossing rate.

According to a third aspect, the present invention provides a coding apparatus, including:

a first coding module, configured to code a low frequency band signal of an input audio signal to obtain a characteristic factor of the input audio signal;

a second coding module, configured to perform coding and spread spectrum prediction on a high frequency band signal of the input audio signal to obtain a first full band signal;

a de-emphasis processing module, configured to perform de-emphasis processing on the first full band signal, where a de-emphasis parameter of the de-emphasis processing is determined according to the characteristic factor;

a calculation module, configured to calculate a first energy of the first full band signal that has undergone de-emphasis processing;

a band-pass processing module, configured to perform band-pass filtering processing on the input audio signal to obtain a second full band signal, where the calculation module is further configured to calculate a second energy of the second full band signal; and calculate an energy ratio of the second energy of the second full band signal to the first energy of the first full band signal; and a sending module, configured to send to a decoding apparatus, a bitstream resulting from coding the input audio signal, where the bitstream includes the characteristic factor, high frequency band coding information, and the energy ratio of the input audio signal.

With reference to the third aspect, in a first possible implementation manner of the third aspect, the coding apparatus further includes a de-emphasis parameter determining module, configured to:

obtain a quantity of characteristic factors;

determine an average value of the characteristic factors according to the characteristic factors and the quantity of the characteristic factors; and determine the de-emphasis parameter according to the average value of the characteristic factors.

With reference to the third aspect or the first possible implementation manner of the third aspect, in a second possible implementation manner of the third aspect, the second coding module is specifically configured to:

determine, according to the high frequency band signal, an LPC coefficient and a full band excitation signal that are used to predict a full band signal; and perform coding processing on the LPC coefficient and the full band excitation signal to obtain the first full band signal.

With reference to any one of the third aspect or the first or the second possible implementation manner of the third aspect, in third possible implementation manner of the third aspect, the de-emphasis processing module is specifically configured to:

perform frequency spectrum movement correction on the first full band signal obtained by the second coding module, and perform frequency spectrum reflection processing on the corrected first full band signal; and perform the de-emphasis processing on the first full band signal that has undergone frequency spectrum reflection processing.

With reference to any one of the third aspect or the first to the third possible implementation manners of the third aspect, in a fourth possible implementation manner of the third aspect, the characteristic factor is used to reflect a characteristic of the audio signal, and includes a voicing factor, a spectral tilt, a short-term average energy, or a short-term zero-crossing rate.

According to a fourth aspect, the present invention provides a decoding apparatus, including:

a receiving module, configured to receive an audio signal bitstream sent by a coding apparatus, where the audio signal bitstream includes a characteristic factor, high frequency band coding information, and an energy ratio of an audio signal corresponding to the audio signal bitstream;

a first decoding module, configured to perform low frequency band decoding on the audio signal bitstream by using the characteristic factor to obtain a low frequency band signal;

a second decoding module, configured to: perform high frequency band decoding on the audio signal bitstream by using the high frequency band coding information to obtain a high frequency band signal, and perform spread spectrum prediction on the high frequency band signal to obtain a first full band signal;

a de-emphasis processing module, configured to perform de-emphasis processing on the first full band signal, where a de-emphasis parameter of the de-emphasis processing is determined according to the characteristic factor;

a calculation module, configured to calculate a first energy of the first full band signal that has undergone de-emphasis processing; and obtain a second full band signal according to the energy ratio included in the audio signal bitstream, the first full band signal that has undergone de-emphasis processing, and the first energy, where the energy ratio is an energy ratio of an energy of the second full band signal to the first energy; and a restoration module, configured to restore the audio signal corresponding to the audio signal bitstream according to the second full band signal, the low frequency band signal, and the high frequency band signal.

With reference to the fourth aspect, in a first possible implementation manner of the fourth aspect, the decoding apparatus further includes a de-emphasis parameter determining module, configured to:

obtain a quantity of characteristic factors through decoding;

determine an average value of the characteristic factors according to the characteristic factors and the quantity of the characteristic factors; and determine the de-emphasis parameter according to the average value of the characteristic factors.

With reference to the fourth aspect or the first possible implementation manner of the fourth aspect, in a second possible implementation manner of the fourth aspect, the second decoding module is specifically configured to:

determine, according to the high frequency band signal, an LPC coefficient and a full band excitation signal that are used to predict a full band signal; and perform coding processing on the LPC coefficient and the full band excitation signal to obtain the first full band signal.

With reference to any one of the fourth aspect or the first or the second possible implementation manner of the fourth aspect, in third possible implementation manner of the fourth aspect, the de-emphasis processing module is specifically configured to:

perform frequency spectrum movement correction on the first full band signal, and perform frequency spectrum reflection processing on the corrected first full band signal; and perform the de-emphasis processing on the first full band signal that has undergone frequency spectrum reflection processing.

With reference to any one of the fourth aspect or the first to the third possible implementation manners of the fourth aspect, in a fourth possible implementation manner of the fourth aspect, the characteristic factor is used to reflect a characteristic of the audio signal, and includes a voicing factor, a spectral tilt, a short-term average energy, or a short-term zero-crossing rate.

According to a fifth aspect, the present invention provides a coding/decoding system, including the coding apparatus according to any one of the third aspect or the first to the fourth possible implementation manners of the third aspect and the decoding apparatus according to any one of the fourth aspect or the first to the fourth possible implementation manners of the fourth aspect.

According to the codec method, apparatus, and system provided in the embodiments of the present invention, de-emphasis processing is performed on a full band signal by using a de-emphasis parameter determined according to a characteristic factor of an input audio signal, and then the full band signal is coded and sent to a decoder, so that the decoder performs corresponding de-emphasis decoding processing on the full band signal according to the characteristic factor of the input audio signal and restores the input audio signal. This resolves the prior-art problem that an audio signal restored by a decoder is apt to signal distortion, and implements adaptive de-emphasis processing on the full band signal according to the characteristic factor of the audio signal to enhance coding performance, so that the input audio signal restored by the decoder has relatively high fidelity and is closer to an original signal.

BRIEF DESCRIPTION OF DRAWINGS

To describe the technical solutions in the embodiments of the present invention more clearly, the following briefly introduces the accompanying drawings required for describing the embodiments. Apparently, the accompanying drawings in the following description show some embodiments of the present invention, and a person of ordinary skill in the art may still derive other drawings from these accompanying drawings without creative efforts.

DESCRIPTION OF EMBODIMENTS

To make the objectives, technical solutions, and advantages of the embodiments of the present invention clearer, the following clearly describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present invention.

Figure 1:
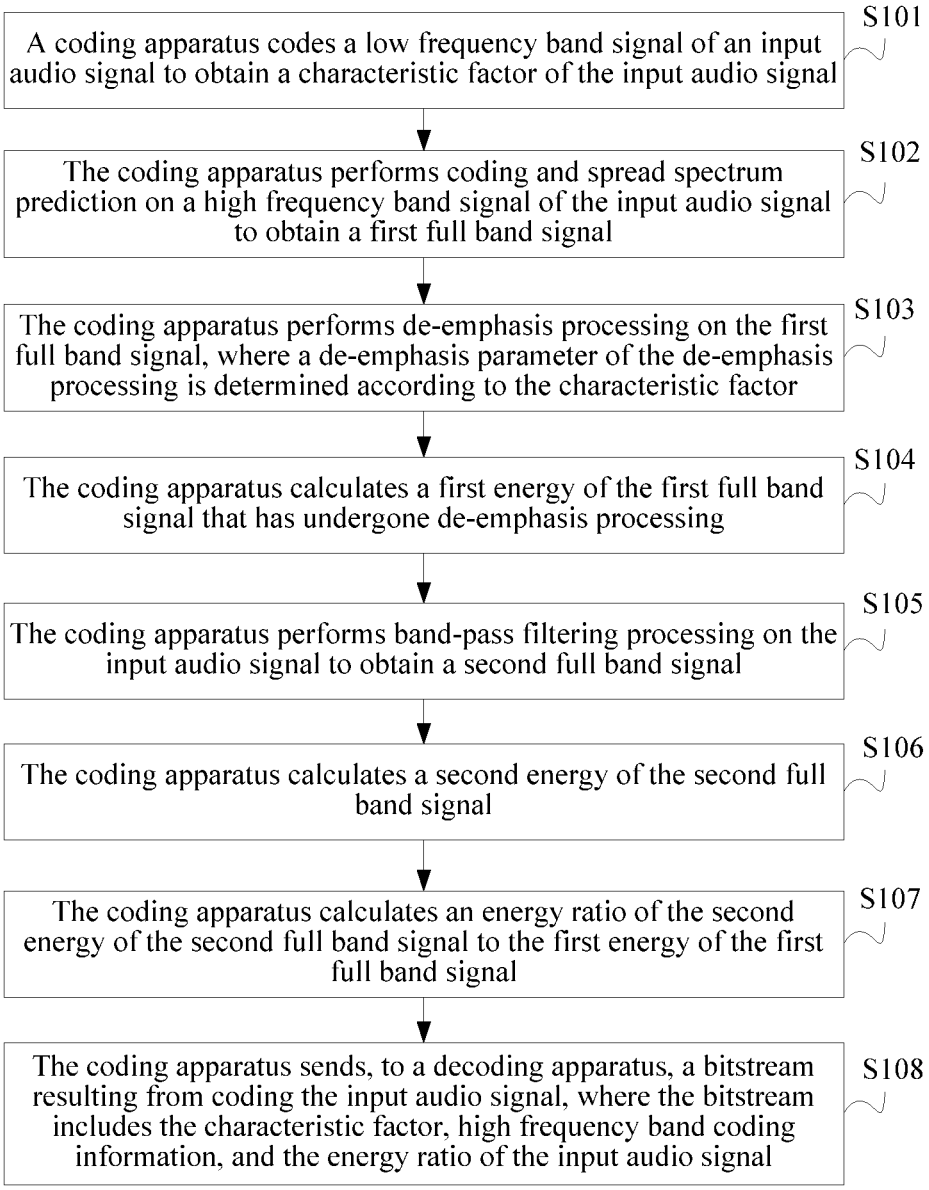
FIG. 1 is a flowchart of an embodiment of a coding method according to an embodiment of the present invention.

FIG. 1 is a schematic flowchart of an embodiment of a coding method according to an embodiment of the present invention. As shown in FIG. 1, the method embodiment includes the following steps:

S101: A coding apparatus codes a low frequency band signal of an input audio signal to obtain a characteristic factor of the input audio signal.

The coded signal is an audio signal. The characteristic factor is used to reflect a characteristic of the audio signal, and includes, but is not limited to, a "voicing factor", a "spectral tilt", a "short-term average energy", or a "short-term zero-crossing rate". The characteristic factor may be obtained by the coding apparatus by coding the low frequency band signal of the input audio signal. Specifically, using the voicing factor as an example, the voicing factor may be obtained through calculation according to a pitch period, an algebraic codebook, and their respective gains extracted from low frequency band coding information that is obtained by coding the low frequency band signal.

S102: The coding apparatus performs coding and spread spectrum prediction on a high frequency band signal of the input audio signal to obtain a first full band signal.

When the high frequency band signal is coded, high frequency band coding information is further obtained.

S103: The coding apparatus performs de-emphasis processing on the first full band signal, where a de-emphasis parameter of the de-emphasis processing is determined according to the characteristic factor.

S104: The coding apparatus calculates a first energy of the first full band signal that has undergone de-emphasis processing.

S105: The coding apparatus performs band-pass filtering processing on the input audio signal to obtain a second full band signal.

S106: The coding apparatus calculates a second energy of the second full band signal.

S107: The coding apparatus calculates an energy ratio of the second energy of the second full band signal to the first energy of the first full band signal.

S108: The coding apparatus sends, to a decoding apparatus, a bitstream resulting from coding the input audio signal, where the bitstream includes the characteristic factor, high frequency band coding information, and the energy ratio of the input audio signal.

Further, the method embodiment further includes:

obtaining, by the coding apparatus, a quantity of characteristic factors;

determining, by the coding apparatus, an average value of the characteristic factors according to the characteristic factors and the quantity of the characteristic factors; and determining, by the coding apparatus, the de-emphasis parameter according to the average value of the characteristic factors.

Specifically, the coding apparatus may obtain one of the characteristic factors. Using an example in which the characteristic factor is the voicing factor, the coding apparatus obtains a quantity of voicing factors, and determines, according to the voicing factors and the quantity of the voicing factors, an average value of the voicing factors of the input audio signal, and further determines the de-emphasis parameter according to the average value of the voicing factors.

Further, the performing, by the coding apparatus, coding and spread spectrum prediction on a high frequency band signal of the input audio signal to obtain a first full band signal in S102 includes:

determining, by the coding apparatus according to the high frequency band signal, an LPC coefficient and a full band excitation signal that are used to predict a full band signal; and performing, by the coding apparatus, coding processing on the LPC coefficient and the full band excitation signal to obtain the first full band signal.

Further, S103 includes:

performing, by the coding apparatus, frequency spectrum movement correction on the first full band signal, and performing frequency spectrum reflection processing on the corrected first full band signal; and performing, by the coding apparatus, the de-emphasis processing on the first full band signal that has undergone frequency spectrum reflection processing.

Optionally, after S103, the method embodiment further includes:

performing, by the coding apparatus, upsampling and band-pass processing on the first full band signal that has undergone de-emphasis processing; and correspondingly, S104 includes:

calculating, by the coding apparatus, a first energy of the first full band signal that has undergone de-emphasis processing, upsampling, and band-pass processing.

A specific implementation manner of the method embodiment is described below by using an example in which the characteristic factor is the voicing factor. For other characteristic factors, their implementation processes are similar thereto, and details are not further described.

Specifically, after receiving an input audio signal, a signaling coding apparatus of a coding apparatus extracts a low frequency band signal from the input audio signal, where a corresponding frequency spectrum range is [0, f1], and codes the low frequency band signal to obtain a voicing factor of the input audio signal. Specifically, the signaling coding apparatus codes the low frequency band signal to obtain low frequency band coding information; calculates according to a pitch period, an algebraic codebook, and their respective gains included in the low frequency band coding information to obtain the voicing factor; and determines a de-emphasis parameter according to the voicing factor. The signaling coding apparatus extracts a high frequency band signal from the input audio signal, where a corresponding frequency spectrum range is [f1, f2]; performs coding and spread spectrum prediction on the high frequency band signal to obtain high frequency band coding information; determines, according to the high frequency band signal, an LPC coefficient and a full band excitation signal that are used to predict a full band signal; performs coding processing on the LPC coefficient and the full band excitation signal to obtain a predicted first full band signal; and performs de-emphasis processing on the first full band signal, where the de-emphasis parameter of the de-emphasis processing is determined according to the voicing factor. After the first full band signal is determined, frequency spectrum movement correction and frequency spectrum reflection processing may be performed on the first full band signal, and then de-emphasis processing may be performed. Optionally, upsampling and band-pass filtering processing may be performed on the first full band signal that has undergone de-emphasis processing. Later, the coding apparatus calculates a first energy Ener0 of the processed first full band signal; performs band-pass filtering processing on the input audio signal to obtain a second full band signal, whose frequency spectrum range is [f2, f3]; determines a second energy Ener1 of the second full band signal; determines an energy ratio (ratio) of Ener1 to Ener0; and includes the characteristic factor, the high frequency band coding information, and the energy ratio of the input audio signal in a bitstream resulting from coding the input audio signal, and sends the bitstream to the decoding apparatus, so that the decoding apparatus restores the audio signal according to the received bitstream, characteristic factor, high frequency band coding information, and energy ratio.

Generally, for a 48-Kilo Hertz (KHz) input audio signal, a corresponding frequency spectrum range [0, f1] of a low frequency band signal of the input audio signal may be specifically [0, 8 KHz], and a corresponding frequency spectrum range [f1, f2] of a high frequency band signal of the input audio signal may be specifically [8 KHz, 16 KHz]. The corresponding frequency spectrum range [f2, f3] corresponding to the second full band signal may be specifically [16 KHz, 20 KHz]. The following describes in detail an implementation manner of the method embodiment by using the specific frequency spectrum ranges as an example. It should be noted that the present invention is applicable to this implementation manner, but is not limited thereto.

In specific implementation, the low frequency band signal corresponding to [0, 8 KHz] may be coded by using a code excited linear prediction (CELP) core encoder, so as to obtain low frequency band coding information. A coding algorithm used by the core encoder may be an existing algebraic code excited linear prediction (ACELP) algorithm, but is not limited thereto.

The pitch period, the algebraic codebook, and their respective gains are extracted from the low frequency band coding information, the voicing factor is obtained through calculation by using the existing algorithm, and details of the algorithm are not further described. After the voicing factor is determined, a de-emphasis factor μ used to calculate the de-emphasis parameter is determined. The following describes, in detail by using the voicing factor as an example, a calculation process in which the de-emphasis factor μ is determined.

A quantity M of obtained voicing factors is first determined, which usually may be 4 or 5. The M voicing factors are summed and averaged, so as to determine an average value varvoiceshape of the voicing factors. The de-emphasis factor μ is determined according to the average value, and a de-emphasis parameter H(Z) may be further obtained according to μ, as indicated by the following formula (1):

$$H(Z)=1/(1-\mu Z^{-1}) \tag{1}$$

where H(Z) is an expression of a transfer function in a Z domain, $Z^{-1}$ represents a delay unit, and μ is determined according to varvoiceshape. Any value related to varvoiceshape may be selected as μ, which may be specifically, but is not limited to: $\mu=\text{varvoiceshape}^3$, $\mu=\text{varvoiceshape}^2$, μ=varvoiceshape, or μ=1−varvoiceshape.

The high frequency band signal corresponding to [8 KHz, 16 KHz] may be coded by using a super wide band time band extension (TBE) encoder. This includes: extracting the pitch period, the algebraic codebook, and their respective gains from the core encoder to restore a high frequency band excitation signal; extracting a high frequency band signal component to perform an LPC analysis to obtain a high frequency band LPC coefficient; integrating the high frequency band excitation signal and the high frequency band LPC coefficient to obtain a restored high frequency band signal; comparing the restored high frequency band signal with the high frequency band signal in the input audio signal to obtain a gain adjustment parameter gain; and quantizing, by using a small quantity of bits, the high frequency band LPC coefficient and the gain parameter gain to obtain high frequency band coding information.

Further, the SWB encoder determines, according to the high frequency band signal of the input audio signal, the full band LPC coefficient and the full band excitation signal that are used to predict the full band signal, and performs integration processing on the full band LPC coefficient and the full band excitation signal to obtain a predicted first full band signal, and then frequency spectrum movement correction may be performed on the first full band signal by using the following formula (2):

$$S2_k=S1_k\times\cos(2\times PI\times f_n\times k/f_s) \tag{2}$$

where k represents the $k^{th}$ time sample point, k is a positive integer, S2 is a first frequency spectrum signal after the frequency spectrum movement correction, S1 is the first full band signal, PI is a ratio of a circumference of a circle to its diameter, fn indicates that a distance that a frequency spectrum needs to move is n time sample points, n is a positive integer, and fs represents a signal sampling rate.

After the frequency spectrum movement correction, frequency spectrum reflection processing is performed on S2 to obtain a first full band signal S3 that has undergone frequency spectrum reflection processing, amplitudes of frequency spectrum signals of corresponding time sample points before and after the frequency spectrum movement are reflected. An implementation manner of the frequency spectrum reflection may be the same as common frequency spectrum reflection, so that the frequency spectrum is arranged in a structure the same as that of an original frequency spectrum, and details are not described further.

Later, de-emphasis processing is performed on S3 by using the de-emphasis parameter H(Z) determined according to the voicing factor, to obtain a first full band signal S4 that has undergone de-emphasis processing, and then energy Ener0 of S4 is determined. Specifically, the de-emphasis processing may be performed by using a de-emphasis filter having the de-emphasis parameter.

Optionally, after S4 is obtained, upsampling processing may be performed, by means of zero insertion, on the first full band signal S4 that has undergone de-emphasis processing, to obtain a first full band signal S5 that has undergone upsampling processing, then band-pass filtering processing may be performed on S5 by using a band pass filter (BPF) having a pass range of [16 KHz, 20 KHz] to obtain a first full band signal S6, and then an energy Ener0 of S6 is determined. The upsampling and the band-pass processing are performed on the first full band signal that has undergone de-emphasis processing, and then the energy of the first full band signal is determined, so that a frequency spectrum energy and a frequency spectrum structure of a high frequency band extension signal may be adjusted to enhance coding performance.

The second full band signal may be obtained by the coding apparatus by performing band-pass filtering processing on the input audio signal by using the band pass filter (BPF) having the pass range of [16 KHz, 20 KHz]. After the second full band signal is obtained, the coding apparatus determines energy Ener1 of the second full band signal, and calculates a ratio of the energy Ener1 to the energy Ener0. After quantization processing is performed on the energy ratio, the energy ratio, the characteristic factor and the high frequency band coding information of the input audio signal are packaged into the bitstream and sent to the decoding apparatus.

In the prior art, the de-emphasis factor μ of the de-emphasis filtering parameter H(Z) usually has a fixed value, and a signal type of the input audio signal is not considered, resulting that the input audio signal restored by the decoding apparatus is apt to have signal distortion.

According to the method embodiment, de-emphasis processing is performed on a full band signal by using a de-emphasis parameter determined according to a characteristic factor of an input audio signal, and then the full band signal is coded and sent to a decoder, so that the decoder performs corresponding de-emphasis decoding processing on the full band signal according to the characteristic factor of the input audio signal and restores the input audio signal. This resolves a prior-art problem that an audio signal restored by a decoder is apt to have signal distortion is resolved, and implements adaptive de-emphasis processing on the full band signal according to the characteristic factor of the audio signal to enhance coding performance, so that the input audio signal restored by the decoder has relatively high fidelity and is closer to an original signal.

Figure 2:
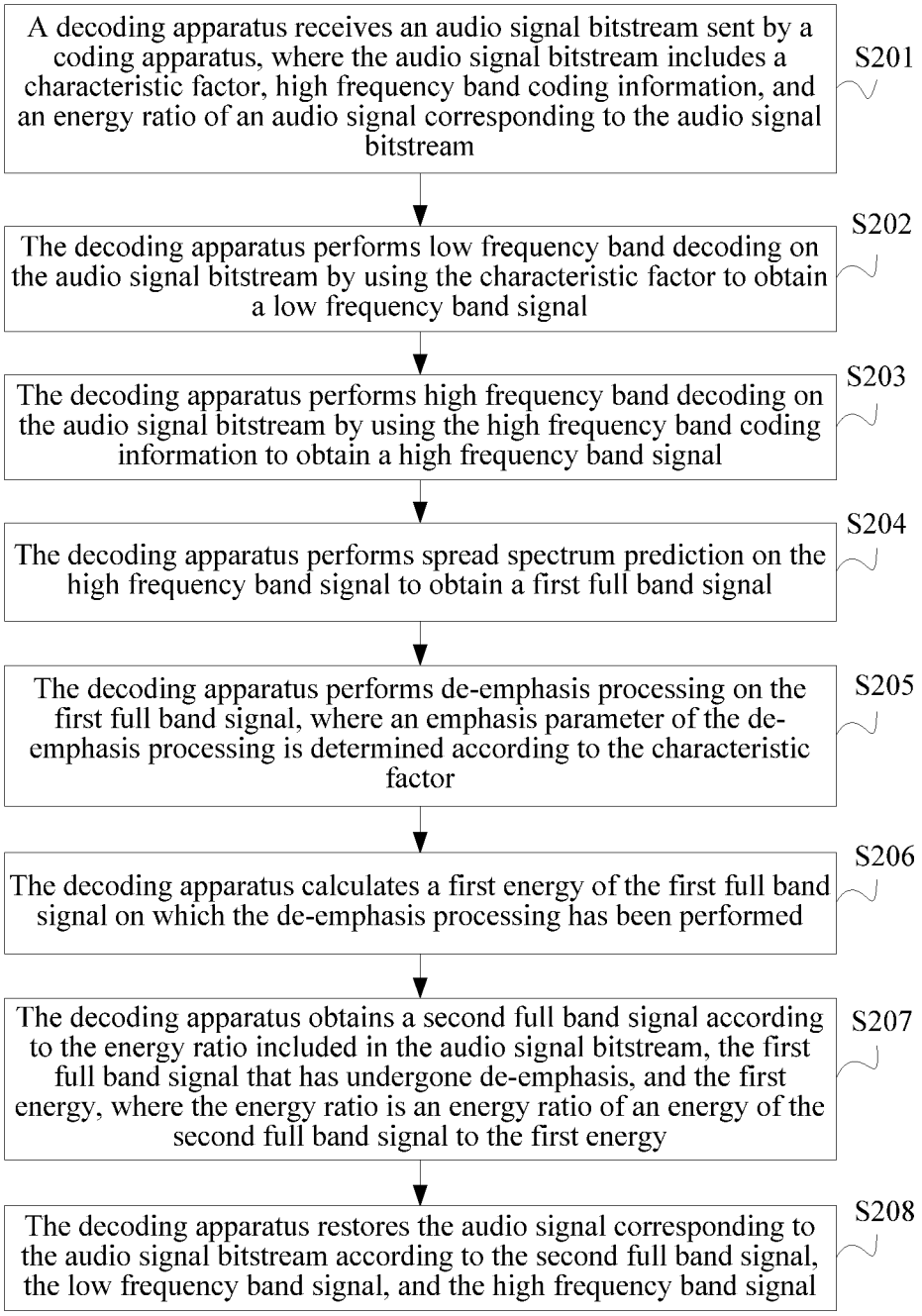
FIG. 2 is a flowchart of an embodiment of a decoding method according to an embodiment of the present invention.

FIG. 2 is a flowchart of an embodiment of a decoding method according to an embodiment of the present invention, and is a decoder side method embodiment corresponding to the method embodiment shown in FIG. 1. As shown in FIG. 2, the method embodiment includes the following steps:

S201: A decoding apparatus receives an audio signal bitstream sent by a coding apparatus, where the audio signal bitstream includes a characteristic factor, high frequency band coding information, and an energy ratio of an audio signal corresponding to the audio signal bitstream.

The characteristic factor is used to reflect a characteristic of the audio signal, and includes, but is not limited to, a "voicing factor", a "spectral tilt", a "short-term average energy", or a "short-term zero-crossing rate". The characteristic factor is the same as the characteristic factor in the method embodiment shown in FIG. 1, and details are not described again.

S202: The decoding apparatus performs low frequency band decoding on the audio signal bitstream by using the characteristic factor to obtain a low frequency band signal.

S203: The decoding apparatus performs high frequency band decoding on the audio signal bitstream by using the high frequency band coding information to obtain a high frequency band signal.

S204: The decoding apparatus performs spread spectrum prediction on the high frequency band signal to obtain a first full band signal.

S205: The decoding apparatus performs de-emphasis processing on the first full band signal, where a de-emphasis parameter of the de-emphasis processing is determined according to the characteristic factor.

S206: The decoding apparatus calculates a first energy of the first full band signal that has undergone de-emphasis processing.

S207: The decoding apparatus obtains a second full band signal according to the energy ratio included in the audio signal bitstream, the first full band signal that has undergone de-emphasis processing, and the first energy, where the energy ratio is an energy ratio of an energy of the second full band signal to the first energy.

S208: The decoding apparatus restores the audio signal corresponding to the audio signal bitstream according to the second full band signal, the low frequency band signal, and the high frequency band signal.

Further, the method embodiment further includes:

obtaining, by the decoding apparatus, a quantity of characteristic factors through decoding;

determining, by the decoding apparatus, an average value of the characteristic factors according to the characteristic factors and the quantity of the characteristic factors; and determining, by the decoding apparatus, the de-emphasis parameter according to the average value of the characteristic factors.

Further, S204 includes:

determining, by the decoding apparatus according to the high frequency band signal, an LPC coefficient and a full band excitation signal that are used to predict a full band signal; and performing, by the decoding apparatus, coding processing on the LPC coefficient and the full band excitation signal to obtain the first full band signal.

Further, S205 includes:

performing, by the decoding apparatus, frequency spectrum movement correction on the first full band signal, and performing frequency spectrum reflection processing on the corrected first full band signal; and performing, by the decoding apparatus, the de-emphasis processing on the first full band signal that has undergone frequency spectrum reflection processing.

Optionally, after S205, the method embodiment further includes:

performing, by the decoding apparatus, upsampling and band-pass filtering processing on the first full band signal that has undergone de-emphasis processing; and correspondingly, S206 includes:

determining, by the decoding apparatus, a first energy of the first full band signal that has undergone de-emphasis processing, upsampling, and band-pass processing.

The method embodiment corresponds to the technical solution in the method embodiment shown in FIG. 1. A specific implementation manner of the method embodiment is described by using an example in which the characteristic factor is a voicing factor. For other characteristic factors, their implementation processes are similar thereto, and details are not described further.

Specifically, a decoding apparatus receives an audio signal bitstream sent by a coding apparatus, where the audio signal bitstream includes a characteristic factor, high frequency band coding information, and an energy ratio of an audio signal corresponding to the audio signal bitstream. Later, the decoding apparatus extracts the characteristic factor of the audio signal from the audio signal bitstream, performs low frequency band decoding on the audio signal bitstream by using the characteristic factor of the audio signal to obtain a low frequency band signal, and performs high frequency band decoding on the audio signal bitstream by using the high frequency band coding information to obtain a high frequency band signal. The decoding apparatus determines a de-emphasis parameter according to the characteristic factor; performs full band signal prediction according to the high frequency band signal obtained through decoding to obtain a first full band signal S1, performs frequency spectrum movement correction processing on S1 to obtain a first full band signal S2 that has undergone frequency spectrum movement correction processing, performs frequency spectrum reflection processing on S2 to obtain a signal S3, performs de-emphasis processing on S3 by using the de-emphasis parameter determined according to the characteristic factor, to obtain a signal S4, and calculates a first energy Ener0 of S4. Optionally, the decoding apparatus performs upsampling processing on the signal S4 to obtain a signal S5, performs band-pass filtering processing on S5 to obtain a signal S6, and then calculates a first energy Ener0 of S6. Later, a second full band signal is obtained according to the signal S4 or S6, Ener0, and the received energy ratio, and the audio signal corresponding to the audio signal bitstream is restored according to the second full band signal, and the low frequency band signal and the high frequency band signal that are obtained through decoding.

In specific implementation, the low frequency band decoding may be performed by a core decoder on the audio signal bitstream by using the characteristic factor to obtain the low frequency band signal. The high frequency band decoding may be performed by a SWB decoder on the high frequency band coding information to obtain the high frequency band signal. After the high frequency band signal is obtained, spread spectrum prediction is performed directly according to the high frequency band signal or after the high frequency band signal is multiplied by an attenuation factor, to obtain a first full band signal, and the frequency spectrum movement correction processing, the frequency spectrum reflection processing, and the de-emphasis processing are performed on the first full band signal. Optionally, the upsampling processing and the band-pass filtering processing are performed on the first full band signal that has undergone de-emphasis processing. In specific implementation, an implementation manner similar to that in the method embodiment shown in FIG. 1 may be used for processing, and details are not described again.

The obtaining a second full band signal according to the signal S4 or S6, Ener0, and the received energy ratio is specifically: performing energy adjustment on the first full band signal according to the energy ratio R and the first energy Ener0 to restore an energy of the second full band signal Ener1=Ener0×R, and obtaining the second full band signal according to a frequency spectrum of the first full band signal and the energy Ener1.

According to the method embodiment, a decoding apparatus determines a de-emphasis parameter by using a characteristic factor of an audio signal that is included in an audio signal bitstream, performs de-emphasis processing on a full band signal, and obtains a low frequency band signal through decoding by using the characteristic factor, so that an audio signal restored by the decoding apparatus is closer to an original input audio signal and has higher fidelity.

Figure 3:
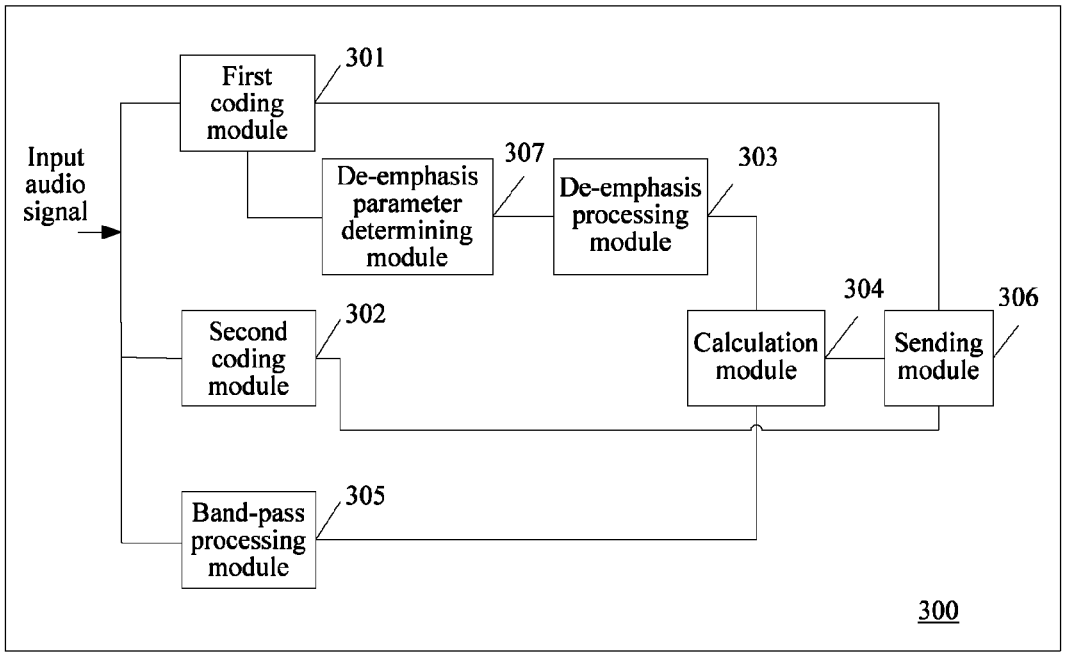
FIG. 3 is a schematic structural diagram of Embodiment 1 of a coding apparatus according to an embodiment of the present invention.

FIG. 3 is a schematic structural diagram of Embodiment 1 of a coding apparatus according to an embodiment of the present invention. As shown in FIG. 3, the coding apparatus 300 includes a first coding module 301, a second coding module 302, a de-emphasis processing module 303, a calculation module 304, a band-pass processing module 305, and a sending module 306, where the first coding module 301 is configured to code a low frequency band signal of an input audio signal to obtain a characteristic factor of the input audio signal, where the characteristic factor is used to reflect a characteristic of the audio signal, and includes a voicing factor, a spectral tilt, a short-term average energy, or a short-term zero-crossing rate;

the second coding module 302 is configured to perform coding and spread spectrum prediction on a high frequency band signal of the input audio signal to obtain a first full band signal;

the de-emphasis processing module 303 is configured to perform de-emphasis processing on the first full band signal, where a de-emphasis parameter of the de-emphasis processing is determined according to the characteristic factor;

the calculation module 304 is configured to calculate a first energy of the first full band signal that has undergone de-emphasis processing;

the band-pass processing module 305 is configured to perform band-pass filtering processing on the input audio signal to obtain a second full band signal;

the calculation module 304 is further configured to calculate a second energy of the second full band signal; and calculate an energy ratio of the second energy of the second full band signal to the first energy of the first full band signal; and the sending module 306 is configured to send to a decoding apparatus, a bitstream resulting from coding the input audio signal, where the bitstream includes the characteristic factor, high frequency band coding information, and the energy ratio of the input audio signal.

Further, the coding apparatus 300 further includes a de-emphasis parameter determining module 307, configured to:

obtain a quantity of characteristic factors;

determine an average value of the characteristic factors according to the characteristic factors and the quantity of the characteristic factors; and determine the de-emphasis parameter according to the average value of the characteristic factors.

Further, the second coding module 302 is specifically configured to:

determine, according to the high frequency band signal, an LPC coefficient and a full band excitation signal that are used to predict a full band signal; and perform coding processing on the LPC coefficient and the full band excitation signal to obtain the first full band signal.

Further, the de-emphasis processing module 303 is specifically configured to:

perform frequency spectrum movement correction on the first full band signal obtained by the second coding module 302, and perform frequency spectrum reflection processing on the corrected first full band signal; and perform the de-emphasis processing on the first full band signal that has undergone frequency spectrum reflection processing.

The coding apparatus provided in this embodiment may be configured to execute the technical solution in the method embodiment shown in FIG. 1. Their implementation principles and technical effects are similar, and details are not described again.

Figure 4:
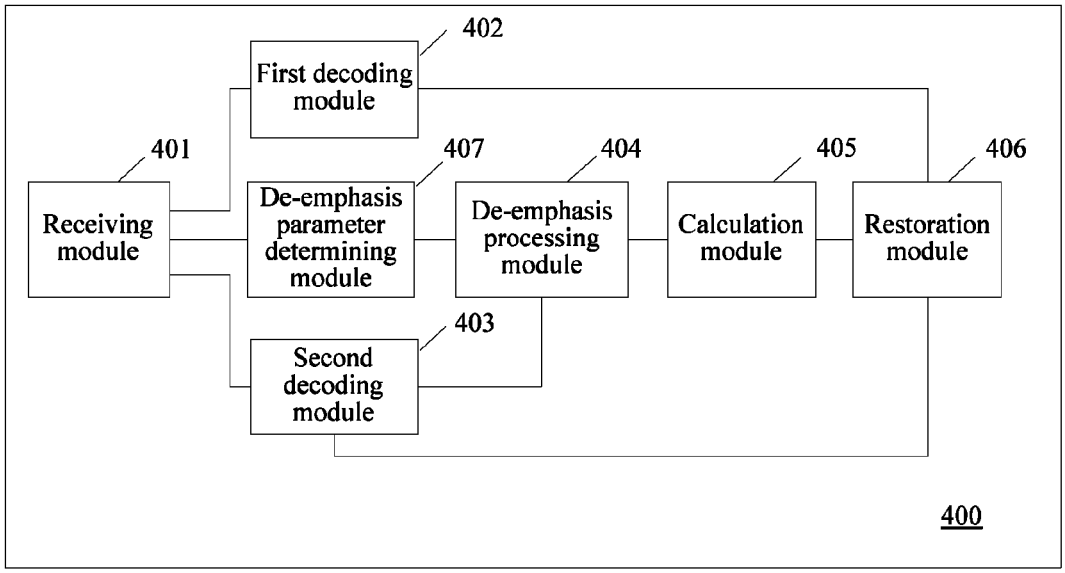
FIG. 4 is a schematic structural diagram of Embodiment 1 of a decoding apparatus according to an embodiment of the present invention.

FIG. 4 is a schematic structural diagram of Embodiment 1 of a decoding apparatus according to an embodiment of the present invention. As shown in FIG. 4, the decoding apparatus 400 includes a receiving module 401, a first decoding module 402, a second decoding module 403, a de-emphasis processing module 404, a calculation module 405, and a restoration module 406, where the receiving module 401 is configured to receive an audio signal bitstream sent by a coding apparatus, where the audio signal bitstream includes a characteristic factor, high frequency band coding information, and an energy ratio of an audio signal corresponding to the audio signal bitstream, where the characteristic factor is used to reflect a characteristic of the audio signal, and includes a voicing factor, a spectral tilt, a short-term average energy, or a short-term zero-crossing rate;

the first decoding module 402 is configured to perform low frequency band decoding on the audio signal bitstream by using the characteristic factor to obtain a low frequency band signal;

the second decoding module 403 is configured to: perform high frequency band decoding on the audio signal bitstream by using the high frequency band coding information to obtain a high frequency band signal, and perform spread spectrum prediction on the high frequency band signal to obtain a first full band signal;

the de-emphasis processing module 404 is configured to perform de-emphasis processing on the first full band signal, where a de-emphasis parameter of the de-emphasis processing is determined according to the characteristic factor;

the calculation module 405 is configured to calculate a first energy of the first full band signal that has undergone de-emphasis processing; and obtain a second full band signal according to the energy ratio included in the audio signal bitstream, the first full band signal that has undergone de-emphasis processing, and the first energy, where the energy ratio is an energy ratio of an energy of the second full band signal to the first energy; and the restoration module 406 is configured to restore the audio signal corresponding to the audio signal bitstream according to the second full band signal, the low frequency band signal, and the high frequency band signal.

Further, the decoding apparatus 400 further includes a de-emphasis parameter determining module 407, configured to:

obtain a quantity of characteristic factors through decoding;

determine an average value of the characteristic factors according to the characteristic factors and the quantity of the characteristic factors; and determine the de-emphasis parameter according to the average value of the characteristic factors.

Further, the second decoding module 403 is specifically configured to:

determine, according to the high frequency band signal, an LPC coefficient and a full band excitation signal that are used to predict a full band signal; and perform coding processing on the LPC coefficient and the full band excitation signal to obtain the first full band signal.

Further, the de-emphasis processing module 404 is specifically configured to:

perform frequency spectrum movement correction on the first full band signal, and perform frequency spectrum reflection processing on the corrected first full band signal; and perform the de-emphasis processing on the first full band signal that has undergone frequency spectrum reflection processing.

The decoding apparatus provided in this embodiment may be configured to execute the technical solution in the method embodiment shown in FIG. 2. Their implementation principles and technical effects are similar, and details are not described again.

Figure 5:
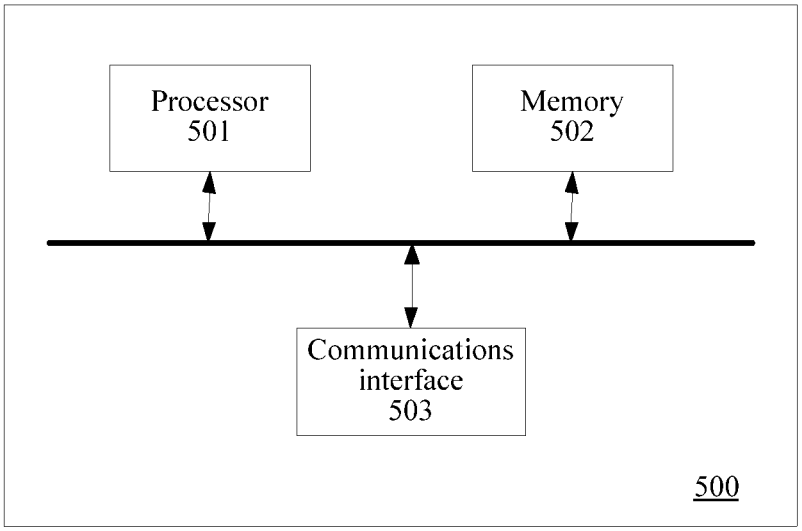
FIG. 5 is a schematic structural diagram of Embodiment 2 of a coding apparatus according to an embodiment of the present invention.

FIG. 5 is a schematic structural diagram of Embodiment 2 of a coding apparatus according to an embodiment of the present invention. As shown in FIG. 5, the coding apparatus 500 includes a processor 501, a memory 502, and a communications interface 503. The processor 501, the memory 502, and communications interface 503 are connected by means of a bus (a bold solid line shown in the figure).

The communications interface 503 is configured to receive input of an audio signal and communicate with a decoding apparatus. The memory 502 is configured to store program code. The processor 501 is configured to call the program code stored in the memory 502 to execute the technical solution in the method embodiment shown in FIG. 1. Their implementation principles and technical effects are similar, and details are not described again.

Figure 6:
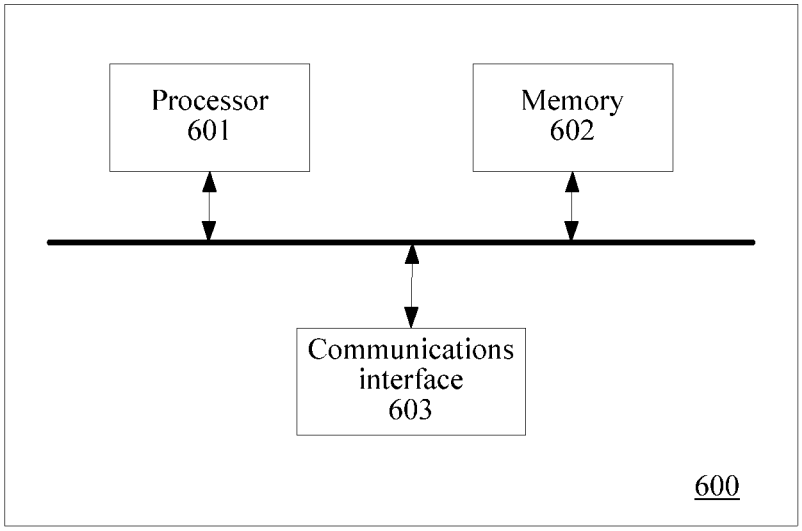
FIG. 6 is a schematic structural diagram of Embodiment 2 of a decoding apparatus according to an embodiment of the present invention.

FIG. 6 is a schematic structural diagram of Embodiment 2 of a coding apparatus according to an embodiment of the present invention. As shown in FIG. 6, the decoding apparatus 600 includes a processor 601, a memory 602, and a communications interface 603. The processor 601, the memory 602, and communications interface 603 are connected by means of a bus (a bold solid line shown in the figure).

The communications interface 603 is configured to communicate with a coding apparatus and output a restored audio signal. The memory 602 is configured to store program code. The processor 601 is configured to call the program code stored in the memory 602 to execute the technical solution in the method embodiment shown in FIG. 2. Their implementation principles and technical effects are similar, and details are not described again.

Figure 7:
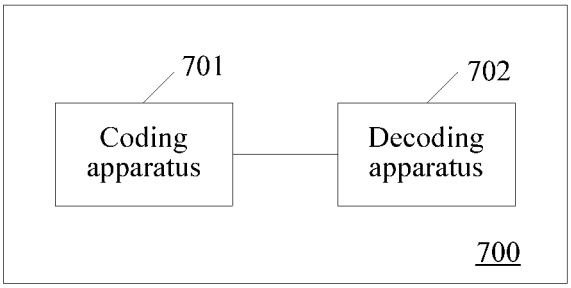
FIG. 7 is a schematic structural diagram of an embodiment of a coding/decoding system according to the present invention.

FIG. 7 is a schematic structural diagram of an embodiment of a coding/decoding system according to the present invention. As shown in FIG. 7, the codec system 700 includes a coding apparatus 701 and a decoding apparatus 702. The coding apparatus 701 and the decoding apparatus 702 may be respectively the coding apparatus shown in FIG. 3 and the decoding apparatus shown in FIG. 4, and may be respectively configured to execute the technical solutions in the method embodiments shown in FIG. 1 and FIG. 2. Their implementation principles and technical effects are similar, and details are not described again.

With descriptions of the foregoing embodiments, a person skilled in the art may clearly understand that the present invention may be implemented by hardware, firmware or a combination thereof. When the present invention is implemented by software, the foregoing functions may be stored in a computer-readable medium or transmitted as one or more instructions or code in the computer-readable medium. The computer-readable medium includes a computer storage medium and a communications medium, where the communications medium includes any medium that enables a computer program to be transmitted from one place to another. The storage medium may be any available medium accessible to a computer. The following provides an example but does not impose a limitation: The computer-readable medium may include a RAM, a ROM, an EEPROM, a CD-ROM, or another optical disc storage or disk storage medium, or another magnetic storage device, or any other medium that can carry or store expected program code in a form of instructions or data structures and can be accessed by a computer. In addition, any connection may be appropriately defined as a computer-readable medium. For example, if software is transmitted from a website, a server or another remote source by using a coaxial cable, an optical fiber/cable, a twisted pair, a digital subscriber line (DSL) or wireless technologies such as infrared ray, radio and microwave, the coaxial cable, optical fiber/cable, twisted pair, DSL or wireless technologies such as infrared ray, radio and microwave are included in the definition of the medium. For example, a disk and disc used by the present invention includes a compact disc CD, a laser disc, an optical disc, a digital versatile disc (DVD), a floppy disk and a Blu-ray disc, where the disk generally copies data by a magnetic means, and the disc copies data optically by a laser means. The foregoing combination should also be included in the protection scope of the computer-readable medium.

Moreover, it should be understood that depending on the embodiments, some actions or events of any method described in this specification may be executed according to different sequences, or may be added, combined, or omitted (for example, to achieve some particular objectives, not all described actions or events are necessary). Moreover, in some embodiments, actions or events may undergo hyper-threading processing, interrupt processing, or simultaneous processing by multiple processors, and the simultaneous processing may be non-sequential execution. In addition, in view of clarity, specific embodiments of the present invention are described as a function of a single step or module, but it should be understood that technologies of the present invention may be combined execution of multiple steps or modules described above.

Finally, it should be noted that the foregoing embodiments are merely intended for describing the technical solutions of the present invention other than limiting the present invention. Although the present invention is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present invention.

What is claimed is:

1. A coding method, comprising:

coding, by a coder, a low frequency band signal of an input audio signal to obtain one or more characteristic factors of the input audio signal;

performing, by the coder, coding and spread spectrum prediction on a high frequency band signal of the input audio signal to obtain a first full band signal;

performing, by the coder, de-emphasis processing on the first full band signal, wherein a de-emphasis parameter of the de-emphasis processing is determined according to the one or more characteristic factors;

calculating, by the coder, a first energy of the first full band signal that has undergone de-emphasis processing;

performing, by the coder, band-pass filtering processing on the input audio signal to obtain a second full band signal;

calculating, by the coder, a second energy of the second full band signal;

calculating, by the coder, an energy ratio of the second energy of the second full band signal to the first energy of the first full band signal; and sending, by the coder to a decoder, a bitstream resulting from coding the input audio signal, wherein the bitstream comprises the one or more characteristic factors, high frequency band coding information, and the energy ratio of the input audio signal.

2. The method according to claim 1, further comprising:

obtaining, by the coder, a quantity of characteristic factors;

determining, by the coder, an average value of the characteristic factors according to the characteristic factors and the quantity of the characteristic factors; and determining, by the coder, the de-emphasis parameter according to the average value of the characteristic factors.

3. The method according to claim 1, wherein the performing, by the coder, spread spectrum prediction on a high frequency band signal of the input audio signal to obtain a first full band signal comprises:

determining, by the coder according to the high frequency band signal, a linear predictive coding (LPC) coefficient and a full band excitation signal that are used to predict a full band signal; and performing, by the coder, coding processing on the LPC coefficient and the full band excitation signal to obtain the first full band signal.

4. The method according to claim 1, wherein the performing, by the coder, de-emphasis processing on the first full band signal comprises:

performing, by the coder, frequency spectrum movement correction on the first full band signal, and performing frequency spectrum reflection processing on the corrected first full band signal; and performing, by the coder, the de-emphasis processing on the first full band signal that has undergone frequency spectrum reflection processing.

5. The method according to claim 1, wherein the characteristic factor is used to reflect a characteristic of the audio signal, and comprises a voicing factor, a spectral tilt, a short-term average energy, or a short-term zero-crossing rate.

6. A decoding method, comprising:

receiving, by a decoder, an audio signal bitstream sent by a coder, wherein the audio signal bitstream comprises one or more characteristic factors, high frequency band coding information, and an energy ratio of an audio signal corresponding to the audio signal bitstream;

performing, by the decoder, low frequency band decoding on the audio signal bitstream by using the one or more characteristic factors to obtain a low frequency band signal;

performing, by the decoder, high frequency band decoding on the audio signal bitstream by using the high frequency band coding information to obtain a high frequency band signal;

performing, by the decoder, spread spectrum prediction on the high frequency band signal to obtain a first full band signal;

performing, by the decoder, de-emphasis processing on the first full band signal, wherein a de-emphasis parameter of the de-emphasis processing is determined according to the one or more characteristic factors;

calculating, by the decoder, a first energy of the first full band signal that has undergone de-emphasis processing;

obtaining, by the decoder, a second full band signal according to the energy ratio comprised in the audio signal bitstream, the first full band signal that has undergone de-emphasis processing, and the first energy, wherein the energy ratio is an energy ratio of an energy of the second full band signal to the first energy; and restoring, by the decoder, the audio signal corresponding to the audio signal bitstream according to the second full band signal, the low frequency band signal, and the high frequency band signal.

7. The method according to claim 6, further comprising:

obtaining, by the decoder, a quantity of characteristic factors through decoding;

determining, by the decoder, an average value of the characteristic factors according to the characteristic factors and the quantity of the characteristic factors; and determining, by the decoder, the de-emphasis parameter according to the average value of the characteristic factors.

8. The method according to claim 6, wherein the performing, by the decoder, spread spectrum prediction on the high frequency band signal to obtain a first full band signal comprises:

determining, by the decoder according to the high frequency band signal, a linear predictive coding (LPC) coefficient and a full band excitation signal that are used to predict a full band signal; and performing, by the decoder, coding processing on the LPC coefficient and the full band excitation signal to obtain the first full band signal.

9. The method according to claim 6, wherein the performing, by the decoder, de-emphasis processing on the first full band signal comprises:

performing, by the decoder, frequency spectrum movement correction on the first full band signal, and performing frequency spectrum reflection processing on the corrected first full band signal; and performing, by the decoder, the de-emphasis processing on the first full band signal that has undergone frequency spectrum reflection processing.

10. The method according to claim 6, wherein the characteristic factor is used to reflect a characteristic of the audio signal, and comprises a voicing factor, a spectral tilt, a short-term average energy, or a short-term zero-crossing rate.

11. A coding apparatus, comprising:

a processor configured to execute computer instructions stored in memory, wherein, when the processor executes the computer instructions, to processor operates to:

code a low frequency band signal of an input audio signal to obtain one or more characteristic factors of the input audio signal;

perform coding and spread spectrum prediction on a high frequency band signal of the input audio signal to obtain a first full band signal;

perform de-emphasis processing on the first full band signal, wherein a de-emphasis parameter of the de-emphasis processing is determined according to the one or more characteristic factors; and calculate a first energy of the first full band signal that has undergone de-emphasis processing;

a band-pass processing circuit, configured to perform band-pass filtering on the input audio signal to obtain a second full band signal, wherein the processor further operates to calculate a second energy of the second full band signal and to calculate an energy ratio of the second energy of the second full band signal to the first energy of the first full band signal; and a sender, configured to send to a decoder, a bitstream resulting from coding the input audio signal, wherein the bitstream comprises the one or more characteristic factors, high frequency band coding information, and the energy ratio of the input audio signal.

12. The coding apparatus according to claim 11, wherein the processor further operates to:

obtain a quantity of characteristic factors;

determine an average value of the characteristic factors according to the characteristic factors and the quantity of the characteristic factors; and determine the de-emphasis parameter according to the average value of the characteristic factors.

13. The coding apparatus according to claim 11, wherein the processor operates to:

determine, according to the high frequency band signal, a linear predictive coding (LPC) coefficient and a full band excitation signal that are used to predict a full band signal; and perform coding processing on the LPC coefficient and the full band excitation signal to obtain the first full band signal.

14. The coding apparatus according to claim 11, wherein the processor operates to:

perform frequency spectrum movement correction on the first full band signal, and perform frequency spectrum reflection processing on the corrected first full band signal as a part of the de-emphasis processing; and perform the de-emphasis processing on the first full band signal that has undergone frequency spectrum reflection processing.

15. The coding apparatus according to claim 11, wherein the characteristic factor is used to reflect a characteristic of the audio signal, and comprises a voicing factor, a spectral tilt, a short-term average energy, or a short-term zero-crossing rate.

16. A decoder, comprising:

a receiver, configured to receive an audio signal bitstream sent by a coder, wherein the audio signal bitstream comprises one or more characteristic factors, high frequency band coding information, and an energy ratio of an audio signal corresponding to the audio signal bitstream;

the decoder including a processor that operates on stored computer instructions to:

perform low frequency band decoding on the audio signal bitstream by using the characteristic factor to obtain a low frequency band signal;

perform high frequency band decoding on the audio signal bitstream by using the high frequency band coding information to obtain a high frequency band signal, and perform spread spectrum prediction on the high frequency band signal to obtain a first full band signal;

perform de-emphasis processing on the first full band signal, wherein a de-emphasis parameter of the de-emphasis processing is determined according to the one or more characteristic factors;

calculate a first energy of the first full band signal that has undergone de-emphasis processing; and obtain a second full band signal according to the energy ratio comprised in the audio signal bitstream, the first full band signal that has undergone de-emphasis processing, and the first energy, wherein the energy ratio is an energy ratio of an energy of the second full band signal to the first energy; and restore the audio signal corresponding to the audio signal bitstream according to the second full band signal, the low frequency band signal, and the high frequency band signal.

17. The decoder according to claim 16, wherein the processor further operates to:

obtain a quantity of characteristic factors through decoding;

determine an average value of the characteristic factors according to the characteristic factors and the quantity of the characteristic factors; and determine the de-emphasis parameter according to the average value of the characteristic factors.

18. The decoder according to claim 16, wherein the processor operates to:

determine, according to the high frequency band signal, a linear predictive coding (LPC) coefficient and a full band excitation signal that are used to predict a full band signal; and perform coding processing on the LPC coefficient and the full band excitation signal to obtain the first full band signal.

19. The decoder according to claim 16, wherein the processor operates to:

perform frequency spectrum movement correction on the first full band signal, and perform frequency spectrum reflection processing on the corrected first full band signal; and perform the de-emphasis processing on the first full band signal that has undergone frequency spectrum reflection processing.

20. The decoder according to claim 16, wherein the characteristic factor is used to reflect a characteristic of the audio signal, and comprises a voicing factor, a spectral tilt, a short-term average energy, or a short-term zero-crossing rate.

* * * * *